US009924264B2

(12) United States Patent
Yoshino

(10) Patent No.: US 9,924,264 B2
(45) Date of Patent: Mar. 20, 2018

(54) MICROPHONE AND MICROPHONE APPARATUS

(71) Applicant: Satoshi Yoshino, Toyko (JP)

(72) Inventor: Satoshi Yoshino, Toyko (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 2 days.

(21) Appl. No.: 15/206,843

(22) Filed: Jul. 11, 2016

(65) Prior Publication Data

US 2017/0034616 A1 Feb. 2, 2017

(30) Foreign Application Priority Data

Jul. 27, 2015 (JP) ..... 2015-147565

(51) Int. Cl.

| | |
|---|---|
| ***H04R 1/02*** | (2006.01) |
| ***H04R 1/32*** | (2006.01) |
| ***H04R 3/00*** | (2006.01) |
| ***H04R 1/40*** | (2006.01) |
| ***H04R 1/38*** | (2006.01) |
| ***H04R 1/22*** | (2006.01) |
| ***H04R 5/027*** | (2006.01) |

(52) U.S. Cl.

CPC ..... *H04R 1/326* (2013.01); *H04R 1/22* (2013.01); *H04R 1/38* (2013.01); *H04R 1/406* (2013.01); *H04R 3/005* (2013.01); *H04R 5/027* (2013.01); *H04R 2410/01* (2013.01); *H04R 2430/20* (2013.01)

(58) Field of Classification Search

CPC ... H04R 1/04; H04R 1/20; H04R 1/22; H04R 1/32; H04R 1/326; H04R 1/40; H04R 1/406; H04R 3/00; H04R 3/005; H04R 5/027; H04R 2430/20; H04R 1/08; H04R 1/38; H04R 2410/01

USPC ..... 381/26, 91, 92, 122, 355, 356, 357, 358, 381/360, 361, 313

See application file for complete search history.

(56) References Cited

U.S. PATENT DOCUMENTS

| | | | | |
|---|---|---|---|---|
| 6,366,679 | B1 * | 4/2002 | Steffen | H04H 20/88 381/26 |
| 2012/0230498 | A1 * | 9/2012 | Shimura | H04R 5/027 381/26 |
| 2016/0286307 | A1 * | 9/2016 | Akino | H04R 1/406 |
| 2017/0026741 | A1 * | 1/2017 | Yoshino | H04R 1/406 |

FOREIGN PATENT DOCUMENTS

| | | |
|---|---|---|
| JP | 2008-61186 | 3/2008 |
| JP | 2008-67178 | 3/2008 |
| JP | 2011-29766 | 2/2011 |

* cited by examiner

*Primary Examiner* — Huyen D Le
(74) *Attorney, Agent, or Firm* — Whitman, Curtis & Cook, P.C.

(57) ABSTRACT

A microphone includes: first and second bi-directional microphone units having respective directional axes arranged on two straight lines passing through one point and radially extending with an interval of 120 degrees; a third bi-directional microphone unit having a directional axis arranged on a straight line perpendicular to a plane formed by the two straight lines; and an omnidirectional microphone unit arranged in sound collection regions of the first, second, and third bi-directional microphone units.

18 Claims, 18 Drawing Sheets

MICROPHONE AND MICROPHONE APPARATUS

BACKGROUND

Technical Field

The present invention relates to a microphone and a microphone apparatus.

Related Art

There is a microphone having a plurality of unidirectional microphone units incorporated in one housing to collect conversation by a plurality of speakers in a conference or the like. For example, a microphone having three unidirectional microphone units provided such that directional axes are radially positioned at intervals of 120 degrees, thereby to enable sound collection in all 360-degree directions is known.

However, such a conventional microphone cannot easily change directions of the directional axes, when the directions of the directional axes need to be changed, for example, in a case where three speakers sit in front of and on the right side and left side of the microphone in a conference or the like, and the installation position of the microphone cannot be changed.

To be specific, in the above-described example, by changing the directions of the microphone units in the housing such that the directional axes mutually make an angle of 90 degrees, more favorable sound collection can be realized. The conventional microphone has a configuration to change the directional axes by physically changing the directions of the microphone units in the housing (JP 2011-29766 A), and thus has a complicated configuration. Further, in such a conventional microphone, a user needs to change the directions of the microphone units in the housing. Further, such a conventional configuration has a problem that change of the direction of the directional axis of the microphone is difficult, when the microphone is installed in a place from which the microphone cannot be easily taken out, for example, when the microphone is hung from a ceiling or embedded in a desk.

JP 2008-61186 A and JP 2008-67178 A describe apparatuses using one omnidirectional microphone unit and two or three bi-directional microphones. However, the apparatuses described in these documents have a configuration in which the directional axes among the bi-directional microphones are perpendicular to one another.

SUMMARY

An object of the present invention is to provide a microphone and a microphone apparatus that can easily change the direction of the directional axis by electrical processing without physically changing the directions of the microphone units.

According to the present invention, there is provided a microphone including: first and second bi-directional microphone units having respective directional axes arranged on two straight lines passing through one point and radially extending with an interval of 120 degrees; a third bi-directional microphone unit having a directional axis arranged on a straight line perpendicular to a plane formed by the two straight lines; and an omnidirectional microphone unit arranged in sound collection regions of the first, second, and third bi-directional microphone units.

DETAILED DESCRIPTION

Figure 1:
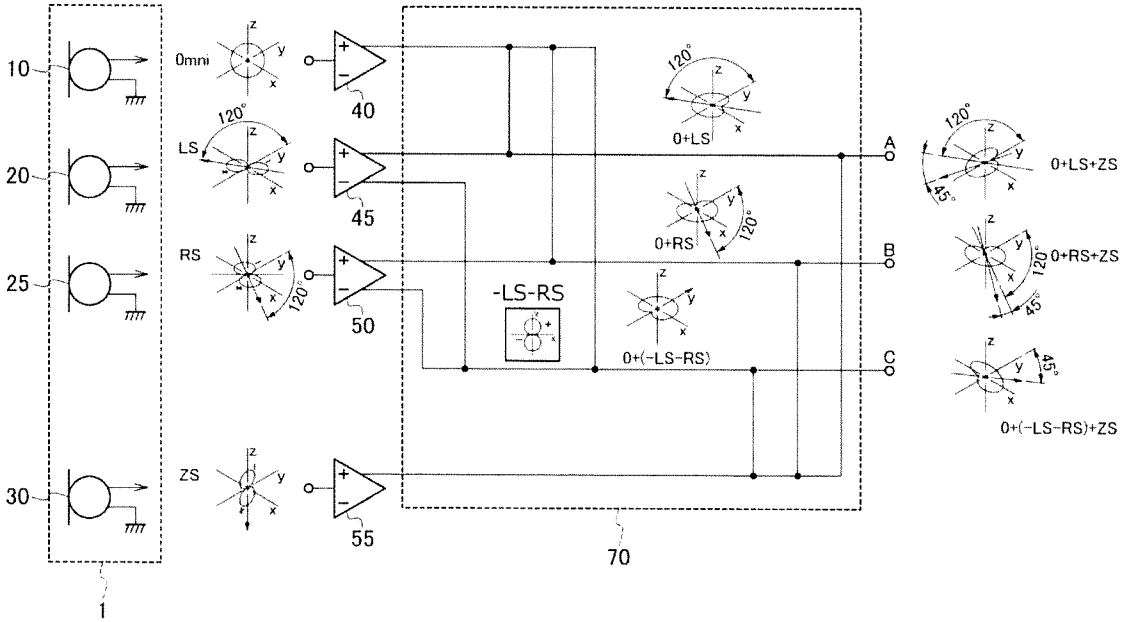
FIG. 1 is a circuit diagram of a microphone apparatus according to an embodiment of the present invention.

Hereinafter, a microphone and a microphone apparatus according to an embodiment of the present invention will be described in detail with reference to the drawings.

A microphone apparatus illustrated in FIG. 1 includes a microphone main body unit (hereinafter, simply referred to as microphone) 1 having four microphone units fixed and installed in a housing, and an output signal processing unit that processes output signals of the microphone units.

The four microphone units fixed and installed in the microphone 1 are made of one omnidirectional microphone unit 10, and first to third bi-directional microphone units 20, 25, and 30. Physical arrangement and positional relationships of the microphone units 10, 20, 25, and 30 will be described below with reference to FIGS. 2 to 5.

Further, in FIG. 1, to clarify the output signals of the microphone units, characteristics of the processed signals, directions of directional axes, and the like, characteristic diagrams of the signals are added on three-dimensional coordinates with X, Y, and Z three axes that are perpendicular to one another, and description thereof will be given below.

The output signal processing unit includes signal processing units 40, 45, 50, and 55 that individually amplify the output signals of the microphone units 10, 20, 25, and 30, and a synthesis circuit 70 as a signal synthesis unit provided at a subsequent stage of the signal processing units 40, 45, 50, and 55.

A signal amplification unit 45 as a first signal processing unit performs non-inverting amplification and inverting amplification for the output signal of the bi-directional microphone unit 20, generates a positive-phase (+) non-inverted signal and a negative-phase (−) inverted signal, and outputs the generated signals to the synthesis circuit 70. Similarly, a signal amplification unit 50 as a second signal processing unit performs non-inverting amplification and inverting amplification for the output signal of the bi-directional microphone unit 25, generates a positive-phase (+) non-inverted signal and negative-phase (−) inverted signal, and outputs the generated signals to the synthesis circuit 70. Hereinafter, the signal amplification units 45 and 50 are also referred to as "non-inverting/inverting amplification circuits". A signal amplification unit 40 as a third signal processing unit amplifies the output signal of the omnidirectional microphone unit 10, and outputs the amplified signal to the synthesis circuit 70. A signal amplification unit 55 as a fourth signal processing unit amplifies (performs non-inverting amplification for) the output signal of the bi-directional microphone unit 30, and outputs the amplified signal to the synthesis circuit 70. Hereinafter, the signal amplification units 40 and 55 are also referred to as "signal amplification circuits".

The synthesis circuit 70 synthesizes the six amplified signals supplied from the signal processing units 40, 45, 50, and 55, and outputs output signals from three terminals A, B, and C. The output signals are supplied to an external apparatus such as a mixer, and signal processing, sound recording, and the like are further performed. The synthesis circuit 70 will be described below in detail.

Next, a configuration of the microphone 1 will be described with reference to FIGS. 2 to 9A and 9B.

Figure 2:
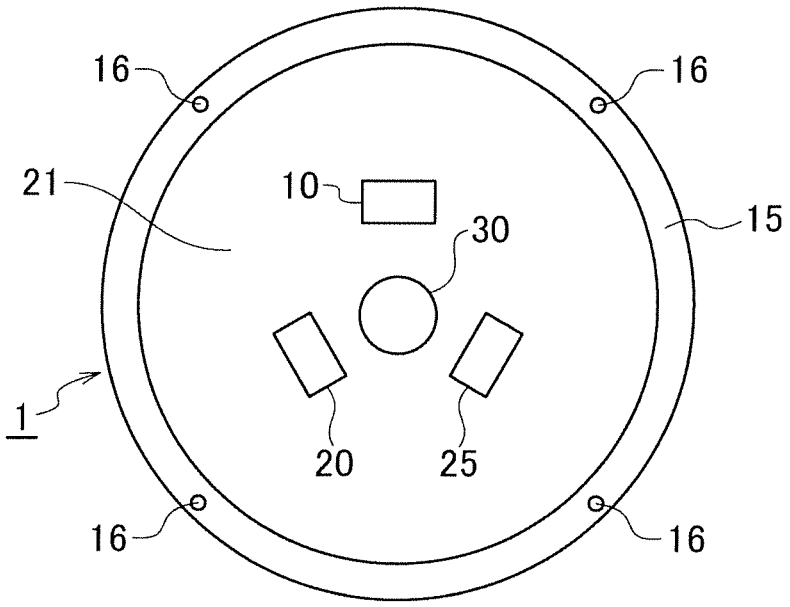
FIG. 2 is a plan view illustrating an arrangement example of microphone units in a microphone of the microphone apparatus.

The microphone 1 illustrated in FIG. 2 includes a housing having an approximately circular plane shape, and the microphone units 10, 20, 25, and 30 are fixed and installed on a substrate 21 provided inside a lower case 15 of the housing. As the microphone units 10, 20, 25, and 30, condenser microphone units are used in this example. A perspective view of the microphone 1 in FIG. 2 is illustrated from another angle is given in FIG. 4.

Figure 4:
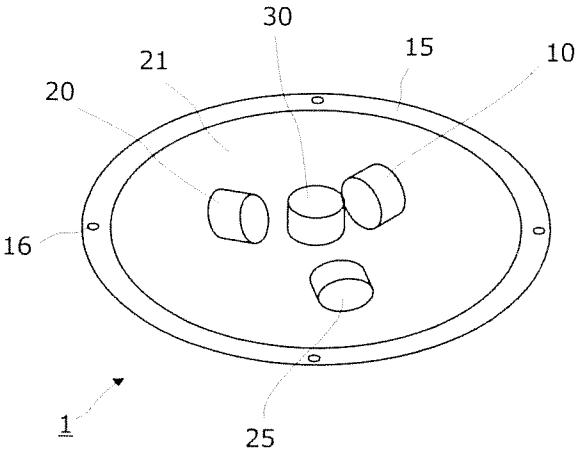
FIG. 4 is a perspective view of the microphone in the arrangement example of FIG. 2 as viewed from a different angle.

FIGS. 2 and 4 illustrate a state in which an upper cover portion of the housing is removed. The upper cover portion is attached to the lower case 15 by being screwed into a plurality of screw holes 16 formed in a side edge of the lower case 15.

Figure 3:
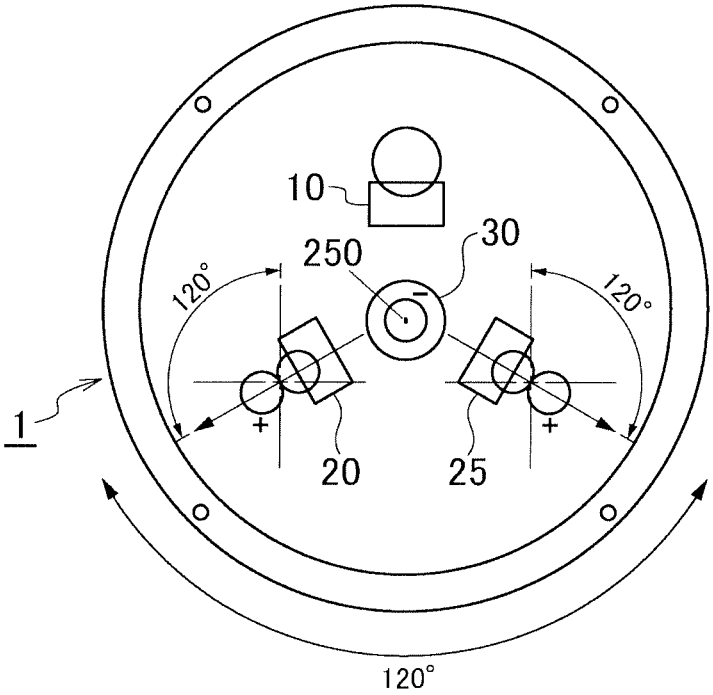
FIG. 3 is a plan view illustrating an arrangement example of the microphone units and directional characteristics of the microphone units.
Figure 5:
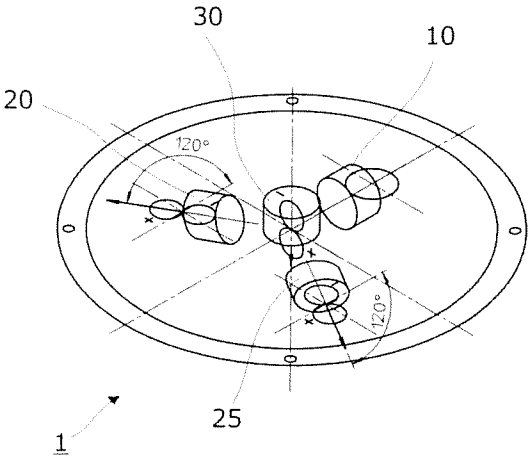
FIG. 5 is a perspective view obtained by adding directional characteristic diagrams of the microphone units and the like to FIG. 4.

FIG. 3 is a diagram obtained by adding, to the configuration of FIG. 2, patterns that indicate directional characteristics of the microphone units 10, 20, 25, and 30, reference lines that indicate positional relationships among the microphone units 10, 20, 25, and 30, and the like. FIG. 5 is a perspective view obtained by adding the patterns of the directional characteristics, the reference lines, and the like corresponding to FIG. 4. As illustrated in FIGS. 3 and 5, the omnidirectional microphone unit 10 and the bi-directional microphone units 20 and 25 are arranged such that central portions of the respective units are positioned on straight lines radially extending from center points of the lower case 15 and the substrate 21 at intervals of 120 degrees. Further, in this example, the three microphone units 10, 20, and 25 are arranged on a plane such that the central portions of the respective units are positioned on a circumference centered at a center point (one point) 250 of the substrate 21.

Further, the bi-directional microphone units 20 and 25 are arranged such that respective directional axes are positioned on straight lines radially extending at angles of 120 degrees, respectively, with respect to a reference line that passes through the central portion of the omnidirectional microphone unit 10 from the center point of the substrate 21. Therefore, the bi-directional microphone units 20 and 25 are fixed and arranged on the substrate 21 such that the respective directional axes are positioned on two straight lines that pass through the center point (one point) 250 of the substrate 21, and radially extend with an interval of 120 degrees in a circumferential direction.

Meanwhile, the bi-directional microphone unit 30 as the third bi-directional microphone unit is arranged on the center point 250 of the substrate 21. Further, the bi-directional microphone unit 30 is arranged such that a directional axis thereof becomes perpendicular to the directional axes of the bi-directional microphone units 20 and 25. To be specific, the directional axes of the bi-directional microphone units 20 and are parallel to the substrate 21. In contrast, the bi-directional microphone unit 30 is arranged such that the directional axis faces downward in a vertical direction of the substrate 21.

Hereinafter, description will be given on the assumption that the directional axes of the bi-directional microphone units 20 and 25 are positioned on an XY plane, and the directional axis of the bi-directional microphone unit 30 is positioned on a Z axis, appropriately using the above-described three-dimensional coordinates with the X, Y, and Z three axes.

As can be seen from FIGS. 1, and 3 to 7, and FIGS. 8A and 8B illustrating actually measured data, the omnidirectional microphone unit 10 has a characteristic of uniformly capturing a sound source in all directions. Meanwhile, as can be seen from FIGS. 1, and 3 to 7, and FIGS. 9A and 9B illustrating actually measured data, the bi-directional microphone units 20, 25, and 30 have a characteristic of strongly capturing sound sources in front-back two directions including a front side (0 deg) and an opposite side (180 deg) in each of the units. In addition, the bi-directional microphone units 20, 25, and 30 have a characteristic of less easily capturing a sound source from a cross direction (90 deg).

Hereinafter, description will be given on the assumption that directivity of capturing the sound source from the front side (the front, 0 deg) of each of the units is a positive (+) phase, and directivity of capturing the sound source from the opposite side (the rear, 180 deg) is a negative (−) phase, in the bi-directional microphone units 20, 25, and 30. Further, hereinafter, a case of hanging and installing the microphone 1 from a ceiling of a concert hall or the like and collecting sounds, with a side on which the omnidirectional microphone unit 10 is installed facing forward, will be described.

Figure 6:
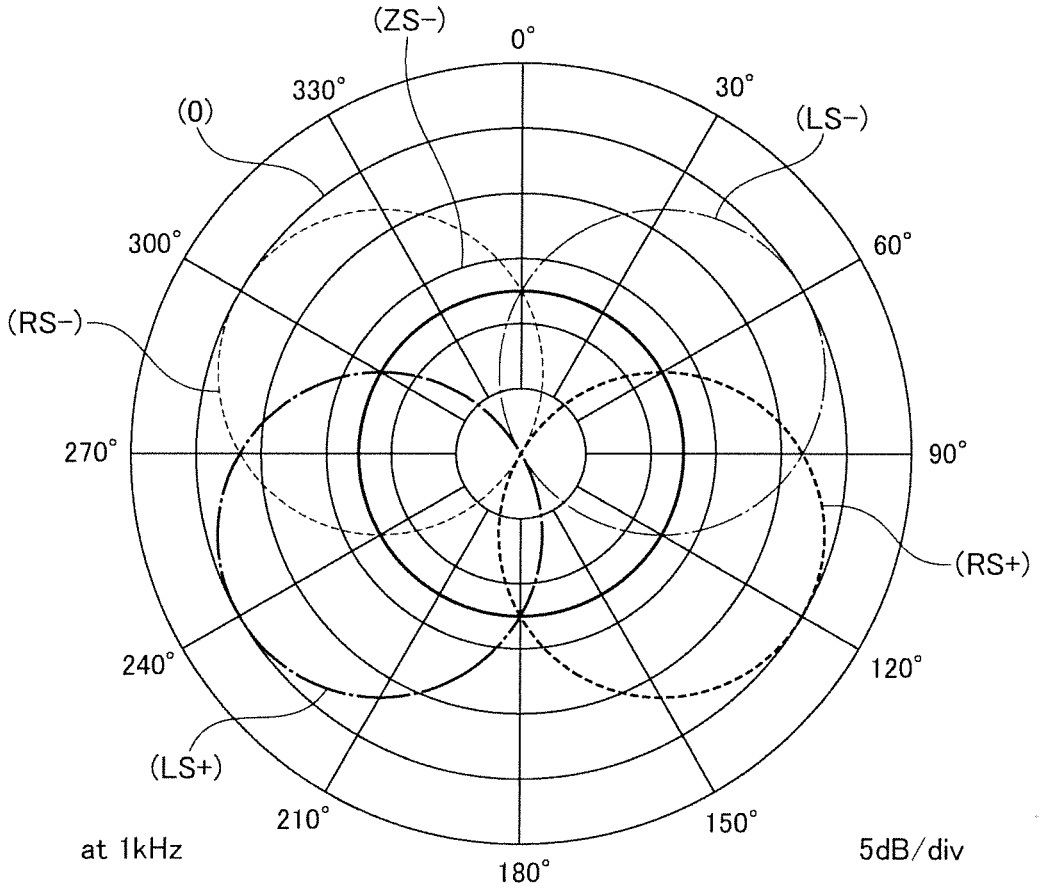
FIG. 6 is a graph two-dimensionally illustrating directional characteristics of each of the microphone units.
Figure 7:
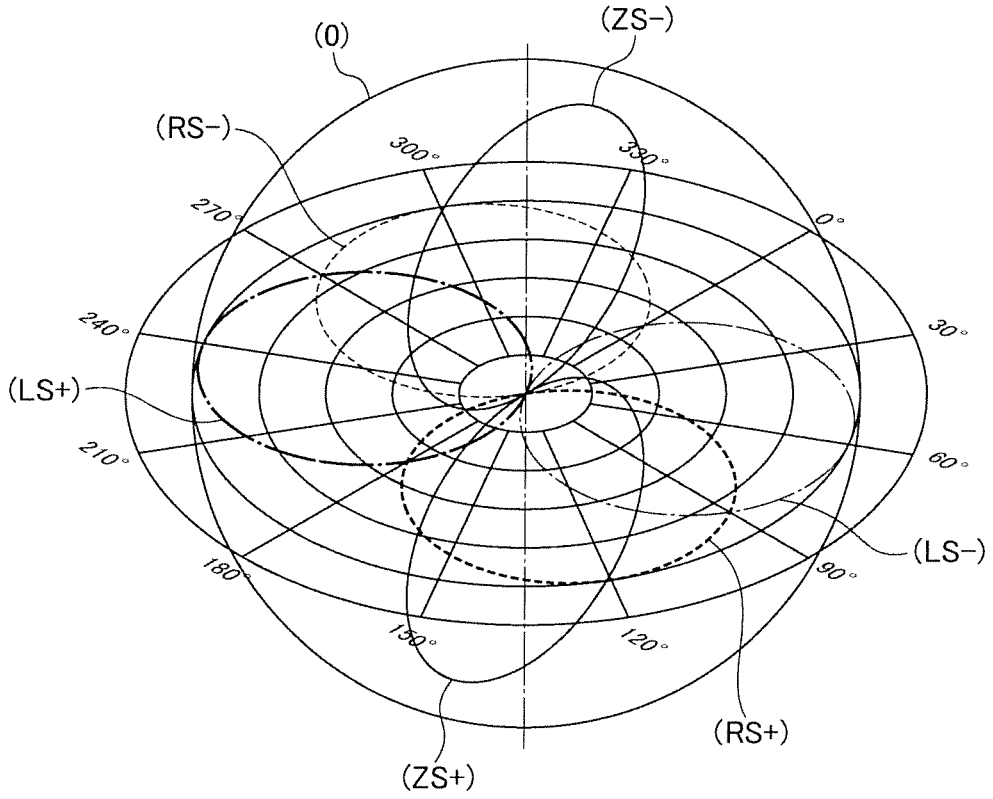
FIG. 7 is a graph three-dimensionally illustrating directional characteristics of each of the microphone units.
Figure 8A:
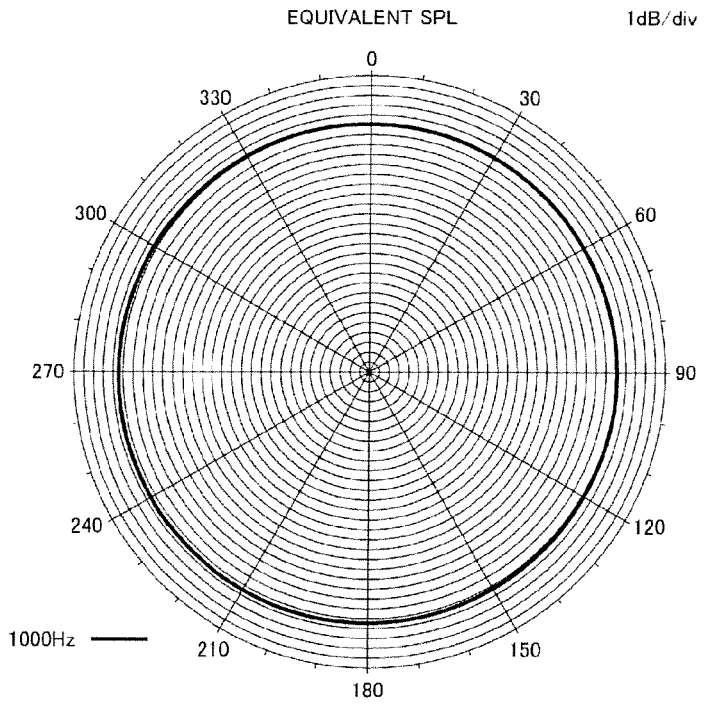
FIG. 8A is a graph illustrating measurement data of an output of an omnidirectional microphone unit, and illustrating directional characteristics of the omnidirectional microphone unit.
Figure 8B:
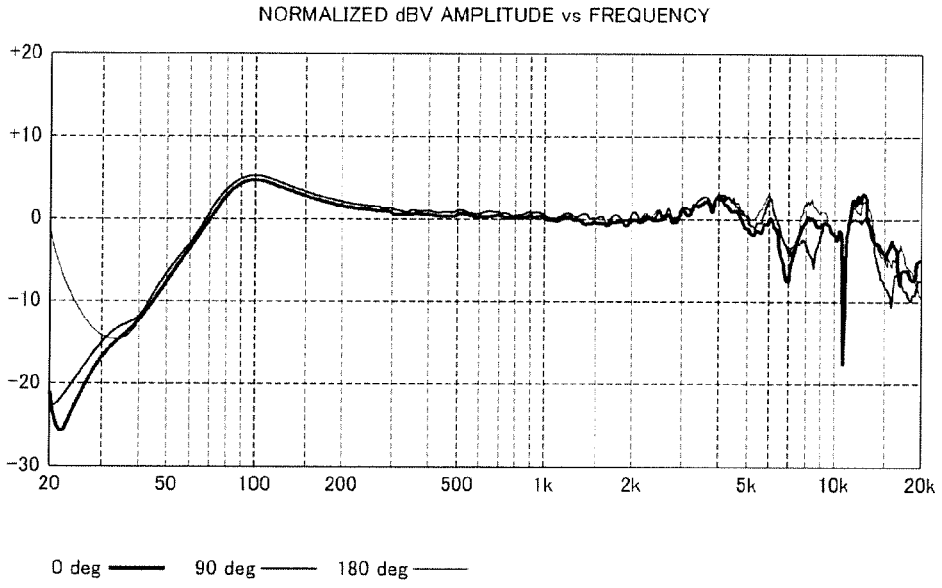
FIG. 8B is a graph illustrating measurement data of an output of an omnidirectional microphone unit, and illustrating frequency characteristics of the omnidirectional microphone unit in directions of 0 degrees, 90 degrees, and 180 degrees.
Figure 9A:
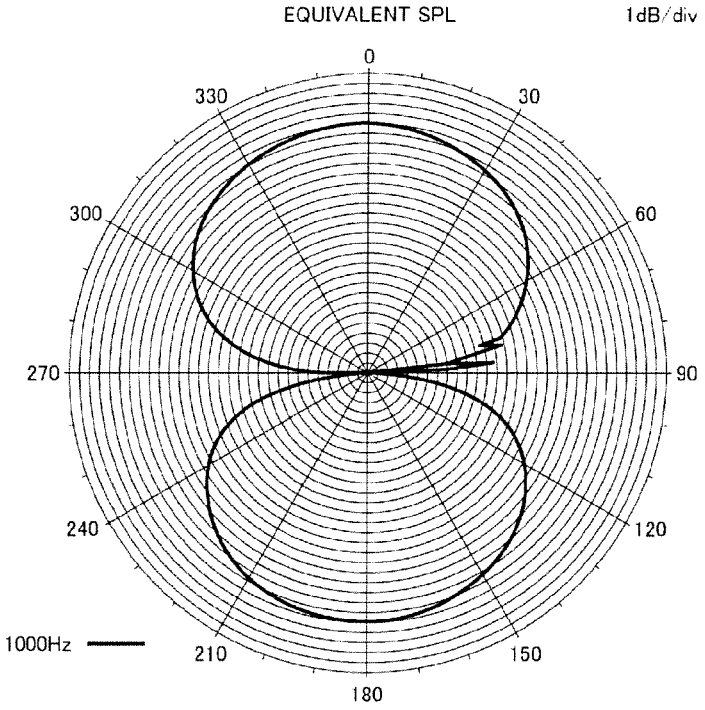
FIG. 9A is a graph illustrating measurement data of an output of a bi-directional microphone unit, and illustrating directional characteristics of the bi-directional microphone unit.
Figure 9B:
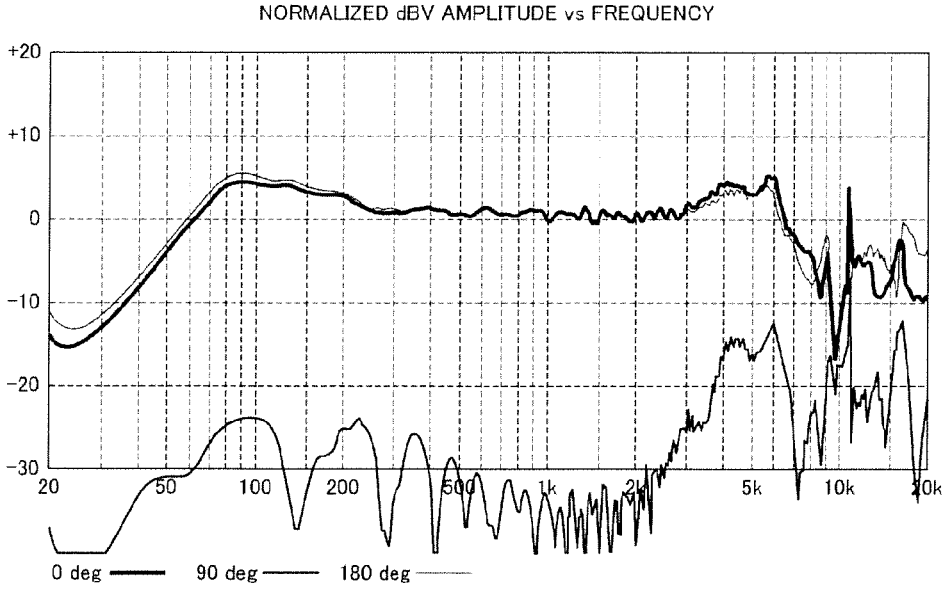
FIG. 9B is a graph illustrating measurement data of an output of a bi-directional microphone unit, and illustrating frequency characteristics of the bi-directional microphone unit in directions of 0 degrees, 90 degrees, and 180 degrees.

In FIGS. 6 and 7, a directivity pattern of the omnidirectional microphone unit 10 is represented by "0", and a directivity pattern of the left-side bi-directional microphone unit 20 is represented by "LS". Further, a directivity pattern of the right-side bi-directional microphone unit 25 is represented by "RS", and a directivity pattern of the central bi-directional microphone unit 30 is represented by "ZS". Further, positive directivity patterns are respectively represented by "LS+", "RS+", and "ZS+", and negative directivity patterns are respectively represented by "LS−", "RS−", and "ZS−", in the bi-directional microphone units 20, 25, and 30. In this example, among the bi-directional microphone units 20, 25, and 30, sensitivities, that is, output signal levels of when a constant sound pressure is received are mutually the same, and further, the sensitivities are also equal to sensitivity of the omnidirectional microphone unit 10.

Next, the signal amplification unit connected to the microphone 1 and the synthesis circuit 70 at a subsequent stage of the signal amplification unit will be described with reference to FIG. 10, and the like. In the example below, the signal amplification unit is a separate body from the microphone 1. However, the signal amplification unit or the synthesis circuit 70 can be incorporated into the housing of the microphone 1.

Figure 10:
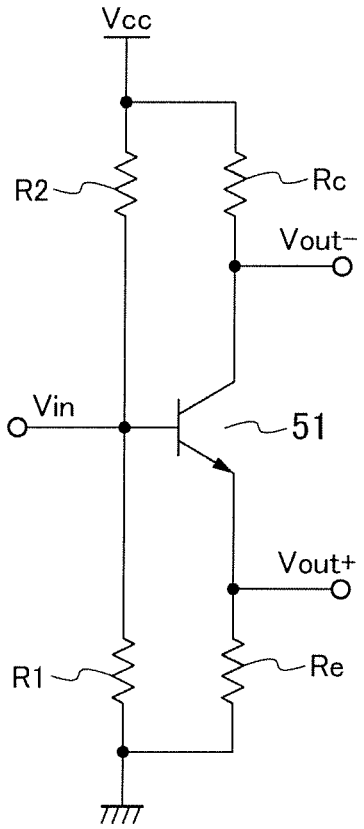
FIG. 10 is a circuit diagram illustrating an example of a circuit configuration of a signal amplification unit.

FIG. 10 illustrates an example of a circuit configuration of the signal amplification unit 40, 45, 50, or 55. As illustrated in FIG. 10, the signal amplification unit to which the microphone unit 10, 20, 25, or 30 is connected is a non-inverting/inverting amplification circuit. The non-inverting/inverting amplification circuit illustrated in FIG. 10 is a balance output circuit in which bias resistances R1 and R2, an emitter resistance Re, and a collector resistance Rc are connected to a transistor 51. In the non-inverting/inverting amplification circuit, the microphone unit is connected to a base of the transistor 51, and the bias resistances R1 and R2 are connected to the base. The bias resistance R1 and the emitter resistance Re are grounded, and a voltage Vcc is applied to the bias resistance R2 and the collector resistance Rc.

The non-inverting/inverting amplification circuit amplifies the output signal of the microphone unit in the transistor 51, and outputs a positive-phase (+) signal from an emitter and a negative-phase (−) signal from a collector.

The signal amplification units 40, 45, 50, and 55 illustrated in FIG. 1 can have the circuit configuration illustrated in FIG. 10. Note that the signal amplification circuit 40 connected to the omnidirectional microphone unit 10 and the signal amplification circuit 55 connected to the bi-directional microphone unit 30 may just output only a non-inverted amplified signal output from a Vout+ terminal illustrated in FIG. 10 to the synthesis circuit 70.

In this example, the signal amplification units 40, 45, 50, and 55 are set to output an amplified signal of the same level to the synthesis circuit 70 when voltage levels of the input signals from the corresponding microphone units are equal to one another.

The synthesis circuit 70 in the embodiment illustrated in FIG. 1 synthesizes the six amplified signals supplied from the signal amplification units 40, 45, 50, and 55 to generate three synthesized signals, and outputs the synthesized signals from the output terminals A, B, and C.

(Output of Output Terminal A)

To be specific, the synthesis circuit 70 synthesizes an amplified signal (hereinafter, referred to as "O signal") input from the signal amplification unit 40 with a positive-phase (+) amplified signal (hereinafter, referred to as "LS signal") input from the signal amplification unit 45 to generate an "O+LS" signal. Further, the synthesis circuit 70 synthesizes the "O+LS" signal with an amplified signal (hereinafter, referred to as "ZS signal") input from the signal amplification unit 55, and outputs a synthesized signal from the output terminal A. By this synthesizing processing, the amplified signals based on the output signals of the omnidirectional microphone unit 10 and the bi-directional microphone units 20 and 30 are synthesized, and an "O+LS+ZS" output signal is generated.

Figure 11:
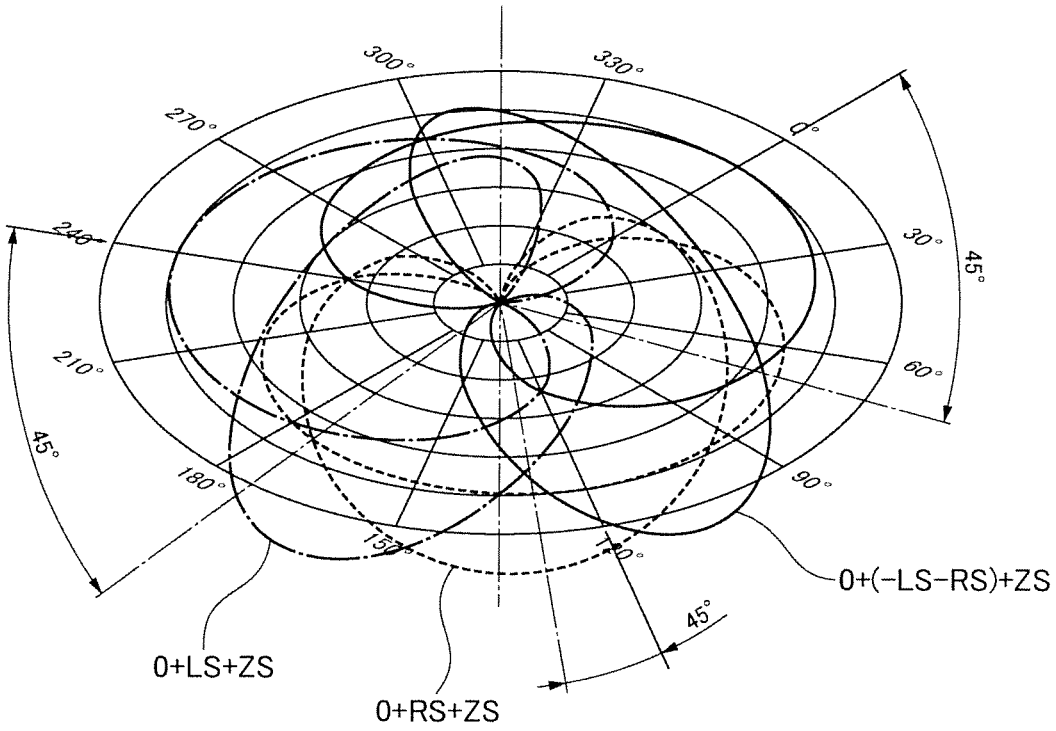
FIG. 11 is a graph illustrating directional characteristics that can be obtained in the embodiment of the microphone apparatus illustrated in FIG. 1.

It can be seen that, in this O+LS+ZS output signal, a sound of a sound source from a downward direction of the installed microphone 1 by 45 degrees and a direction of being rotated leftward from the front side (the front) by 120 degrees is intensified, as illustrated in FIGS. 1 and 11. Therefore, a unidirectional output signal by a cardioid shape characteristic with a directional axis rotated downward by 45 degrees and leftward by 120 degrees can be obtained from the output terminal A.

Figure 12:
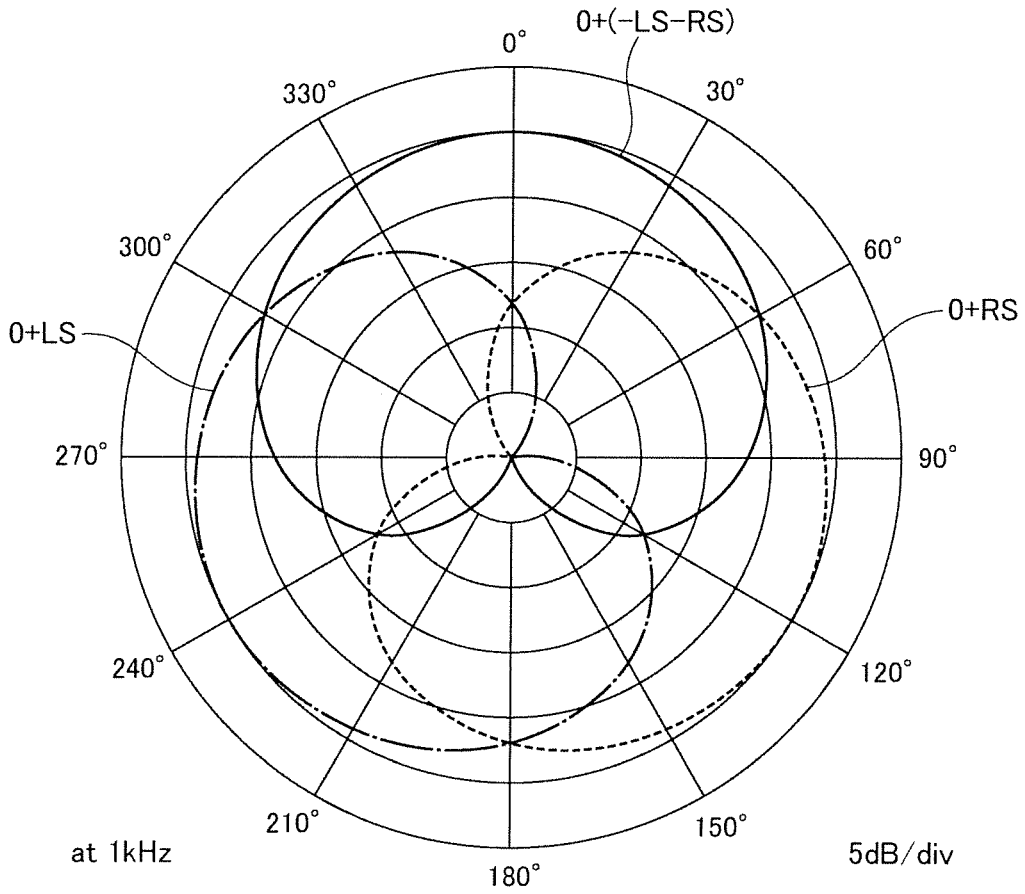
FIG. 12 is a graph illustrating directional characteristics of an intermediate signal before a ZS signal is synthesized in the embodiment illustrated in FIG. 1.
Figure 13A:
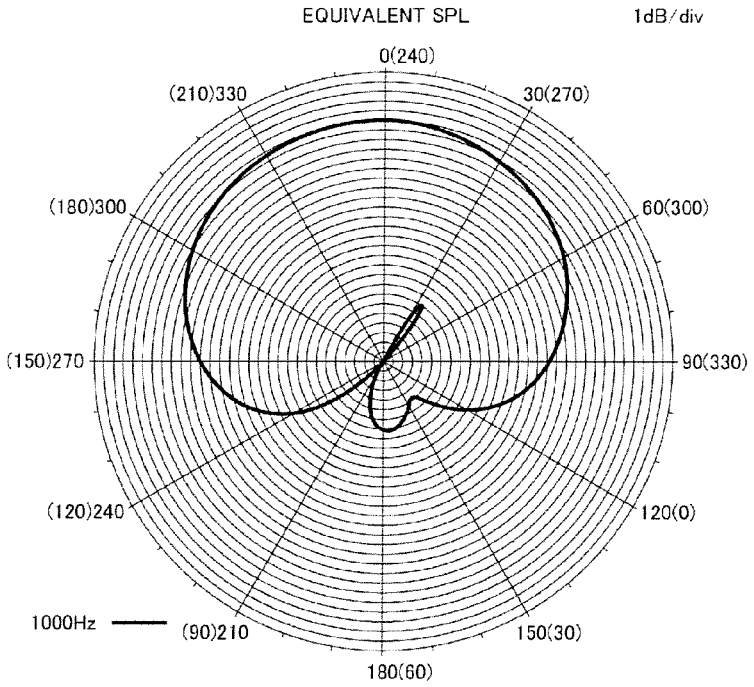
FIG. 13A is a graph illustrating data obtained by actually measuring an output of an "O+LS" signal as an intermediate signal, and illustrating directional characteristics of the "O+LS" signal.
Figure 13B:
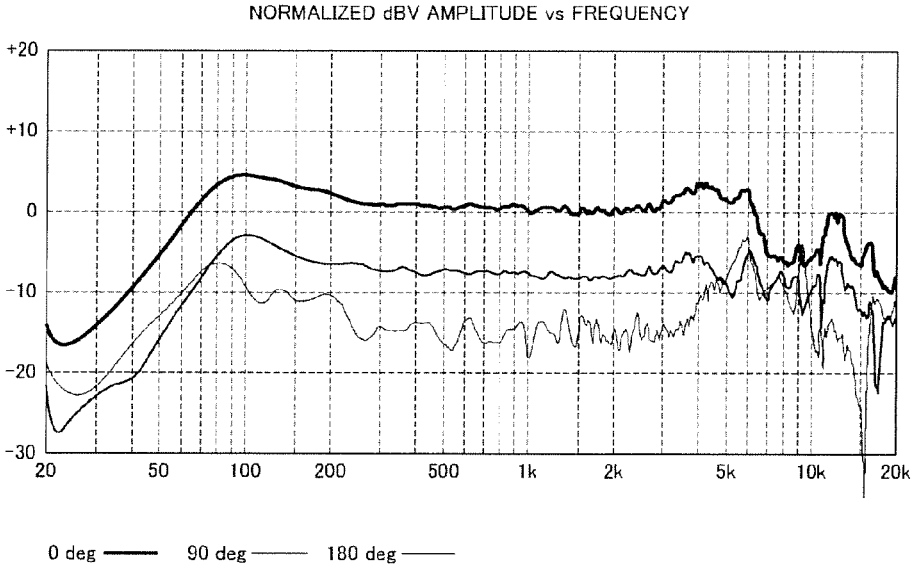
FIG. 13B is a graph illustrating data obtained by actually measuring an output of an "O+LS" signal as an intermediate signal, and illustrating frequency characteristics of the "O+LS" signal in directions of 0 degrees, 90 degrees, and 180 degrees.

For easy understanding, FIGS. 1 and 12 additionally illustrate a characteristic diagram of the "O+LS" signal as an intermediate signal. Further, measurement data obtained by actually measuring the "O+LS" intermediate signal is illustrated in FIGS. 13A and 13B. Regarding FIG. 13A, because of the specification of used measuring equipment, a direction of the highest sensitivity is 0° and a signal is output based on the direction. However, actual directions (angles) are the numerical values with brackets added to FIG. 13A based on the installation direction of the microphone 1.

As can be seen from the aforementioned drawings, the O+LS signal is a unidirectional signal by a cardioid curve with a directional axis facing leftward by 120 degrees based on the Y axis on a horizontal plane in the XYZ three-dimensional coordinates, that is, on the XY plane. When synthesizing the O+LS signal with the ZS signal with a directional axis in a vertical direction, that is, the Z axis direction, a unidirectional signal by a cardioid curve with a directional axis facing downward by 45 degrees and leftward by 120 degrees is generated as the O+LS+ZS signal. The generated O+LS+ZS signal is output from the output terminal A.

(Output of Output Terminal B)

The synthesis circuit 70 synthesizes the O signal input from the signal processing unit 40 with a positive-phase (+) amplified signal (hereinafter, referred to as "RS signal") input from the signal processing unit 50 to generate an "O+RS" signal. Further, the synthesis circuit 70 synthesizes the "O+RS" signal with the ZS signal input from the signal amplification unit 55, and outputs a synthesized signal from the output terminal B. By this synthesizing processing, the amplified signals based on the output signals of the omnidirectional microphone unit 10 and the bi-directional microphone units 25 and 30 are synthesized, and an "O+RS+ZS" output signal is generated.

It can be seen that, in this O+RS+ZS output signal, a sound of a sound source from a downward direction of the installed microphone 1 by 45 degrees, and a direction of being rotated rightward from the front side (the front) by 120 degrees is intensified, as illustrated in FIGS. 1 and 11. In other words, the O+RS+ZS output signal is a unidirectional signal by a cardioid curve with a directional axis facing downward by 45 degrees and rightward by 120 degrees. Therefore, a unidirectional output signal by a cardioid shape characteristic with a directional axis rotated downward by 45 degrees and rightward by 120 degrees can be obtained from the output terminal B.

For easy understanding, FIGS. 1 and 12 additionally illustrate a characteristic diagram of the "O+RS" signal as an intermediate signal. As can be seen from the characteristic diagram, the "O+RS" signal is a unidirectional signal by a cardioid curve with a directional axis facing rightward by 120 degrees based on the Y axis on the XY plane. By synthesizing the O+RS signal with the ZS signal, the unidirectional signal by a cardioid curve with a directional axis facing downward by 45 degrees and rightward by 120 degrees is generated as the O+RS+ZS signal, and is output from the output terminal B.

(Output of Output Terminal C)

The synthesis circuit 70 synthesizes the O signal input from the signal processing unit 40 with a negative-phase (−) amplified signal (hereinafter, referred to as "−LS signal") input from the signal processing unit 45 to generate an "O+(−LS)" signal. Further, the synthesis circuit 70 synthesizes the "O+(−LS)" signal with a negative-phase (−) amplified signal (hereinafter, referred to as "−RS signal" input from the signal processing unit 50 to generate an "O+(−LS−RS)" signal. Further, the synthesis circuit 70 synthesizes the "O+(−LS−RS)" signal with the ZS signal input from the signal amplification unit 55, and outputs a synthesized signal from the output terminal C. By this synthesizing processing, the amplified signals based on the output signals of the omnidirectional microphone unit 10 and the bi-directional microphone units 20, 25, and 30 are synthesized, and an "O+(−LS−RS)+ZS" output signal is generated.

It can be seen that, in this O+(−LS−RS)+ZS output signal, a sound of a sound source from the front direction of the installed microphone 1 and a direction of being rotated downward by 45 degrees is intensified, as illustrated in FIGS. 1 and 11. In other words, the O+(−LS−RS)+ZS output signal is a unidirectional signal by a cardioid curve with a directional axis facing a downward by 45 degrees and the front direction. Therefore, a unidirectional output signal by a cardioid shape characteristic with a directional axis facing the front (forward) direction and downward by 45 degrees can be obtained from the output terminal C.

Figure 14A:
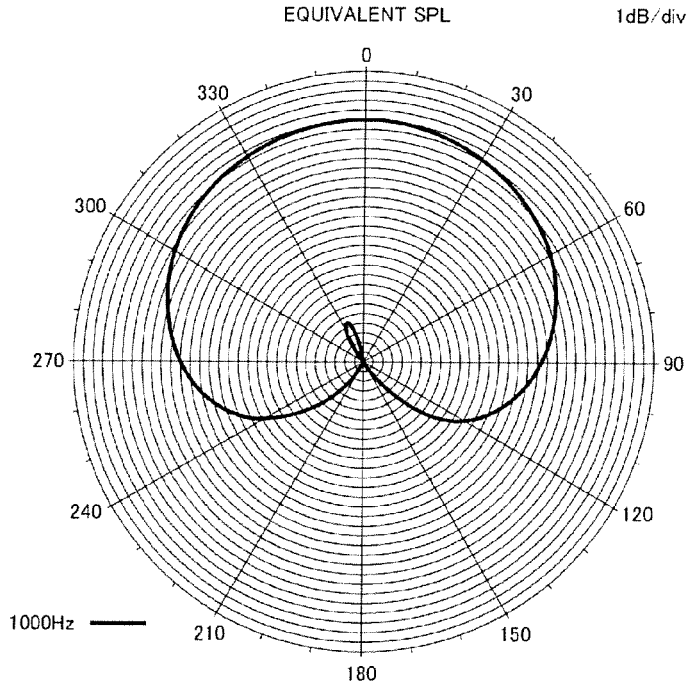
FIG. 14A is a graph illustrating data obtained by actually measuring an output of an "O+(−LS−RS)" signal as an intermediate signal, and illustrating directional characteristics of the "O+(−LS−RS)" signal.
Figure 14B:
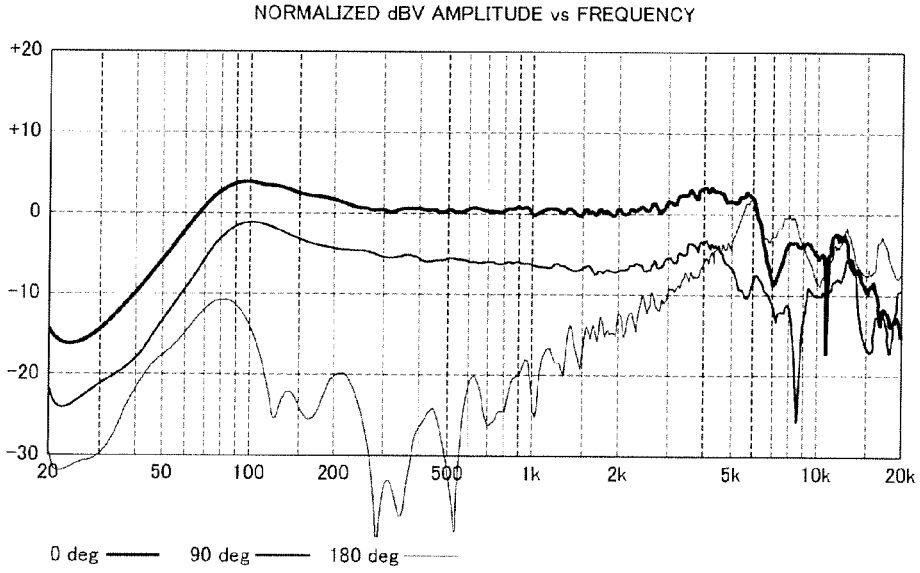
FIG. 14B is a graph illustrating data obtained by actually measuring an output of an "O+(−LS−RS)" signal as an intermediate signal, and illustrating frequency characteristics of the "O+(−LS−RS)" signal in directions of 0 degrees, 90 degrees, and 180 degrees.

For easy understanding, FIGS. 1 and 12 additionally illustrate a characteristic diagram of the "O+(−LS−RS)" signal as an intermediate signal. FIGS. 14A and 14B illustrate measurement data obtained by actually measuring the O+(−LS−RS) output signal. Further, FIG. 1 additionally illustrates the characteristic diagram of the (−LS−RS) signal. Here, t can be seen that the (−LS−RS) signal is a bi-directional signal with a directional axis facing the front on the XY plane, that is, the Y axis direction. The O+(−LS−RS) signal obtained by synthesizing the O signal with the (−LS−RS) signal is a unidirectional signal by a cardioid curve. However, it can be seen that the direction of the directional axis is the same, that is, the direction of the directional axis faces the Y axis direction. By synthesizing the O+(−LS−RS) signal with the ZS signal, the unidirectional signal by a cardioid curve with a directional axis facing downward by 45 degrees and the front direction is generated as the O+(−LS−RS)+ZS output signal, and is output from the output terminal C.

As described above, in the embodiment illustrated in FIG. 1, the output signal by a cardioid shape characteristic with a directional axis facing downward by 45 degrees and leftward by 120 degrees can be obtained from the terminal A, and the output signal by a cardioid shape characteristic with a directional axis facing downward by 45 degrees and rightward by 120 degrees can be obtained from the terminal B. Further, the output signal by a cardioid shape characteristic with a directional axis facing downward by 45 degrees and the front can be obtained from the terminal C.

That is, in the microphone apparatus illustrated in FIG. 1, the output signals having three directivities with the directional axes facing downward by 45 degrees and mutually shifted by 120 degrees in the cross direction of the directional axes, that is, in the directions on the XY plane, are output from the mutually different output terminals. Here, by selecting one of the output terminals A, B, and C, the directional axis of the unidirectional microphone can be easily switched with an electrical switching operation. Note that the number of the output terminals to be selected is not limited to one, and a plurality of the output terminals may be selected.

Next, another embodiment of a microphone apparatus including a synthesis circuit having a different configuration will be described with reference to FIG. 15.

(Output of Output Terminal A)

Figure 15:
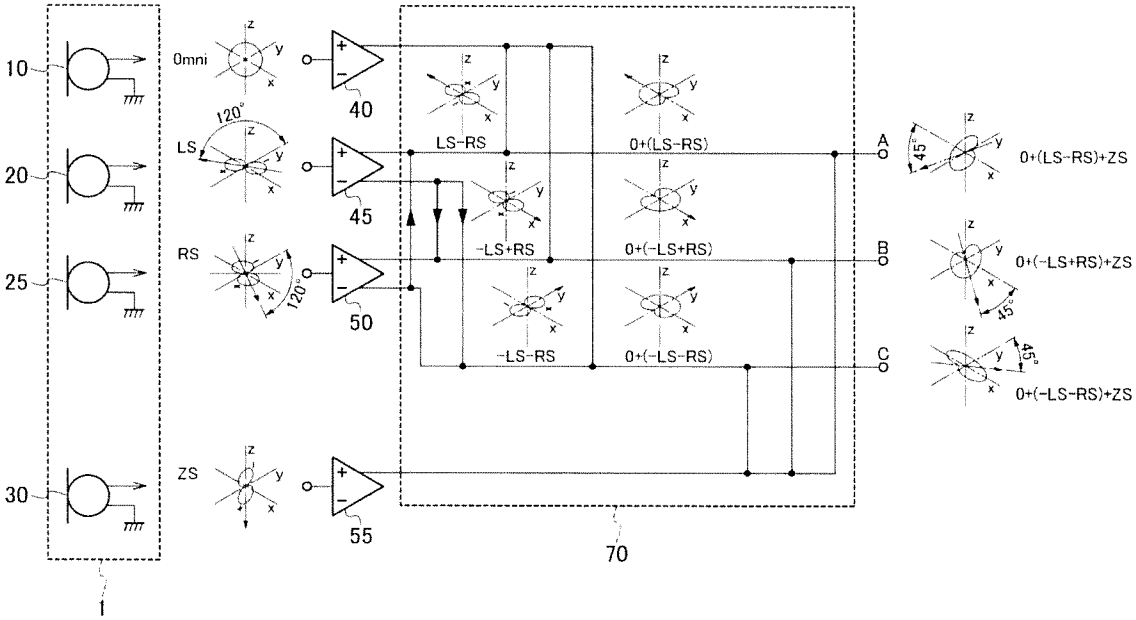
FIG. 15 is a circuit diagram illustrating another embodiment of a microphone apparatus according to the present invention.

In FIG. 15, a synthesis circuit 70 synthesizes an O signal input from a signal amplification unit 40, an LS signal input from a signal amplification unit 45, a −RS signal input from a signal amplification unit 50, and a ZS signal input from a signal amplification unit 55. A synthesized signal thereof is output from an output terminal A as an O+(LS−RS)+ZS signal.

This O+(LS−RS)+ZS output signal has characteristics that a sound of a sound source from a left direction of an installed microphone 1 by 90 degrees and a downward direction by 45 degrees is intensified, and a sound of a sound source from an opposite direction, that is, from a right direction by 90 degrees and an upward direction by 45 degrees is weakened. Therefore, this O+(LS−RS)+ZS signal is a signal with a directional axis rotated and moved rightward by 30 degrees, compared with the O+LS+ZS signal output from the output terminal A of the synthesis circuit of FIG. 1.

For easy understanding, FIG. 15 additionally illustrates characteristic diagrams of an (LS−RS) signal and an O+(LS−RS) signal as intermediate signals. First, it can be seen that the (LS−RS) signal is a bi-directional signal with a directional axis facing leftward by 90 degrees. By synthesizing the (LS−RS) signal with the O signal, a synthesized signal becomes a unidirectional signal by a cardioid curve with a directional axis facing leftward by 90 degrees, as the O+(LS−RS) signal. Further, by synthesizing the O+(LS−RS) signal with the ZS signal, the directional axis of the O+(LS−RS) signal positioned on an XY plane is rotated and moved downward by 45 degrees. Therefore, a unidirectional output signal by a cardioid shape characteristic with a directional axis facing leftward by 90 degrees and downward by 45 degrees can be obtained from the output terminal A.

(Output of Output Terminal B)

The synthesis circuit 70 synthesizes the O signal input from the signal amplification unit 40, a −LS signal input from the signal amplification unit 45, an RS signal input from the signal amplification unit 50, and the ZS signal input from the signal amplification unit 55. A synthesized signal thereof is output from an output terminal B as an O+(−LS+RS)+ZS signal.

This O+(−LS+RS)+ZS output signal has characteristics that a sound of a sound source from a right direction of the installed microphone 1 by 90 degrees and a downward direction by 45 degrees is intensified, and a sound of a sound source from an opposite direction, that is, from a left direction by 90 degrees and an upward direction by 45 degrees is weakened. Therefore, this O+(−LS+RS)+ZS signal is a signal with a directional axis rotated and moved leftward by 30 degrees, compared with the O+RS+ZS signal output from the output terminal B of the synthesis circuit of FIG. 1.

For easy understanding, FIG. 15 additionally illustrates characteristic diagrams of an (−LS+RS) signal and an O+(−LS+RS) signal as intermediate signals. As can be seen from the characteristic diagrams, the (−LS+RS) signal is a bi-directional signal with a directional axis facing rightward by 90 degrees. By synthesizing the (−LS+RS) signal with the O signal, a synthesized signal becomes a unidirectional signal by a cardioid curve with a directional axis facing rightward by 90 degrees, as the O+(−LS+RS) signal. Further, by synthesizing the O+(−LS+RS) signal with the ZS signal, the directional axis of the O+(−LS+RS) signal positioned on an XY plane is rotated and moved downward by 45 degrees. Therefore, a unidirectional output signal by a cardioid shape characteristic with a directional axis facing rightward by 90 degrees and downward by 45 degrees can be obtained from the output terminal B.

(Output of Output Terminal C)

An negative-phase (−) amplified signal (−RS signal) input from the signal amplification unit 50 is synthesized with a −LS signal from the signal amplification unit 45, the O signal from the signal amplification unit 40, and the ZS signal from the signal amplification unit 55, similarly to FIG. 1. Therefore, an O+(−LS−RS)+ZS signal, which is the same as that in FIG. 1, is output from an output terminal C.

In this way, in the embodiment illustrated in FIG. 15, the output signal by a cardioid shape characteristic with a directional axis rotated leftward by 90 degrees and downward by 45 degrees can be obtained from the output terminal A. Further, the output signal by a cardioid shape characteristic with a directional axis rotated rightward by 90 degrees and downward by 45 degrees can be obtained from the output terminal B. Further, the output signal by a cardioid shape characteristic with a directional axis facing forward and rotated downward by 45 degrees can be obtained from the output terminal C.

That is, in the microphone apparatus illustrated in FIG. 15, the output signals having three directivities with the directional axes facing downward by 45 degrees and mutually shifted by 90 degrees in the cross direction of the directional axes, that is, in the directions on the XY plane, are output from the mutually different output terminals. Even in the embodiment illustrated in FIG. 15, by selecting one of the output terminals A, B, and C with an electrical switching operation, the directional axis of the unidirectional microphone can be easily switched. Note that a plurality of the output terminals may be selected, similarly to the above description.

As described above, in the microphone 1 of the present embodiment, the directional axes of the pair of right and left bi-directional microphone units 20 and 25 are arranged on the two straight lines passing through one point and radially extending with an interval of 120 degrees in a circumferential direction. In addition, in the microphone 1, the directional axis of the directional microphone unit 30 is arranged on the straight line perpendicular to the XY plane formed by the above-described two straight lines, that is, on the Z axis. Further, in the microphone 1, the omnidirectional microphone unit 10 is arranged in sound collection regions of the bi-directional microphone units 20, 25, and 30. According to the microphone 1 having such a basic configuration, the direction of the directional axis can be easily changed by electrical processing.

That is, in the present embodiment, it is not necessary to change the physical positions of the microphone units in the housing and also not necessary to touch the microphone 1 in order to change the directions of the directional axes like a conventional configuration using three unidirectional microphone units. Therefore, according to the present embodiment, it is not necessary to provide a complicated mechanism for position change of the microphone units like a conventional case. In addition, there are no restrictions on the installation place of the microphone.

The circuits illustrated in FIGS. 1 and 15 have been described as mutually different embodiments. However, the configuration of the synthesis circuit 70 illustrated in FIG. 1 and the configuration of the synthesis circuit 70 illustrated in FIG. 15 may be switched with a switching switch.

In a case of using the switch, a configuration to switch connections of FIGS. 1 and 15, that is, ON/OFF states for changing the direction of the directivity with a physical interlock switch can be employed.

As another example, a configuration to separately switch the connections of FIGS. 1 and 15 with a plurality of switches may be employed. In this case, an output signal by a cardioid shape characteristic in a form where one directional axis is rotated in a horizontal direction by 90 degrees and downward by 45 degrees, and the other directional axis is rotated in the horizontal direction by 120 degrees and downward by 45 degrees can be obtained.

Further, as another example, a configuration to control the switching of the switch using a personal computer (PC) or the like in a software manner can be employed.

(Level Adjustment Unit)

Further, to continuously change the characteristics of the directivities of the signals output from the output terminals A, B, and C, a level adjustment unit that adjusts a level of the output signal of the microphone unit (10 to 30) can be provided in the signal amplification unit (40 to 55).

Figure 16:
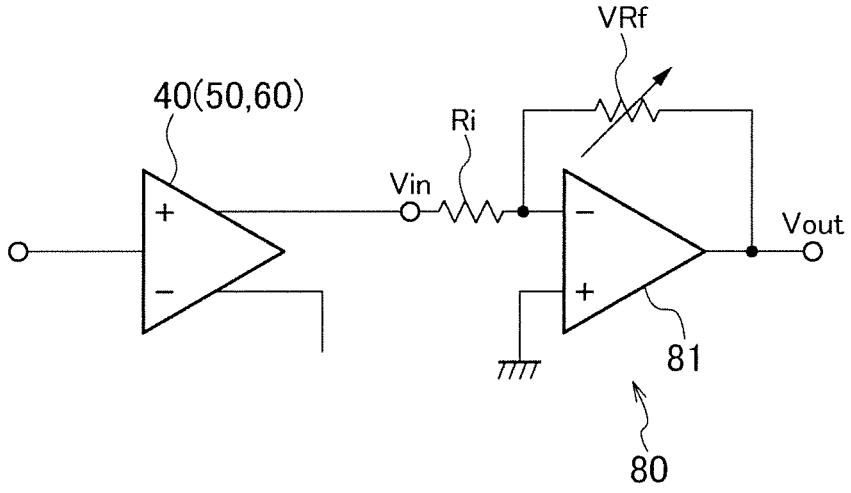
FIG. 16 is a circuit diagram illustrating an example of an output level adjustment circuit of a microphone unit.

FIG. 16 illustrates a circuit configuration example in which the level adjustment unit is provided in each output line of the signal amplification unit 40, 45, 50, or 55. This level adjustment unit 80 is a circuit having an input resistance R1 connected to a minus side input terminal of an operational amplifier 81 and a feedback resistance connected between an output side and the minus side input terminal of the operational amplifier 81. A variable resistor VRf is used for the feedback resistance. In the level adjustment unit 80, a gain of the operational amplifier is determined according to a ratio to a resistance value set in the variable resistor VRf and a resistance value of the input resistance Ri. Therefore, by providing the level adjustment unit 80 in each output line of the signal amplification unit 40, 45, 50, or 55, the output signal level of each microphone unit can be adjusted by adjusting the variable resistor VRf of the level adjustment unit 80.

Figure 17:
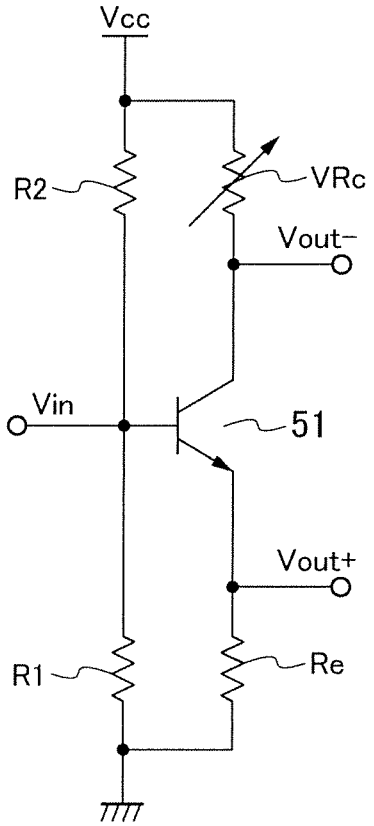
FIG. 17 is a circuit diagram illustrating another example of an output level adjustment circuit of a microphone unit.

FIG. 17 illustrates a circuit configuration example in which the level adjustment unit is provided in the signal amplification unit (non-inverting/inverting amplification circuit) 40, 45, 50, or 55 to which the microphone unit 10, 20, 25, or 30 is connected. This non-inverting/inverting amplification circuit includes a variable resistor VRc in place of the collector resistance connected to the transistor 51 in the non-inverting/inverting amplification circuit illustrated in FIG. 10. According to the non-inverting/inverting amplification circuit illustrated in FIG. 17, by adjusting a resistance value of the variable resistor VRc, the output signal level of the negative-phase (−) signal of the microphone unit, and a the positive-phase (+) output signal level can be adjusted.

Further, circuits equivalent to the level adjustment unit illustrated in FIG. 16 can be provided to subsequent stages of the output terminals A to C of the synthesis circuit 70. With such a configuration, the output levels of the three-phase signals supplied to an external apparatus can be individually adjusted.

(Microphone Sensitivity Adjustment Unit)

Figure 18:
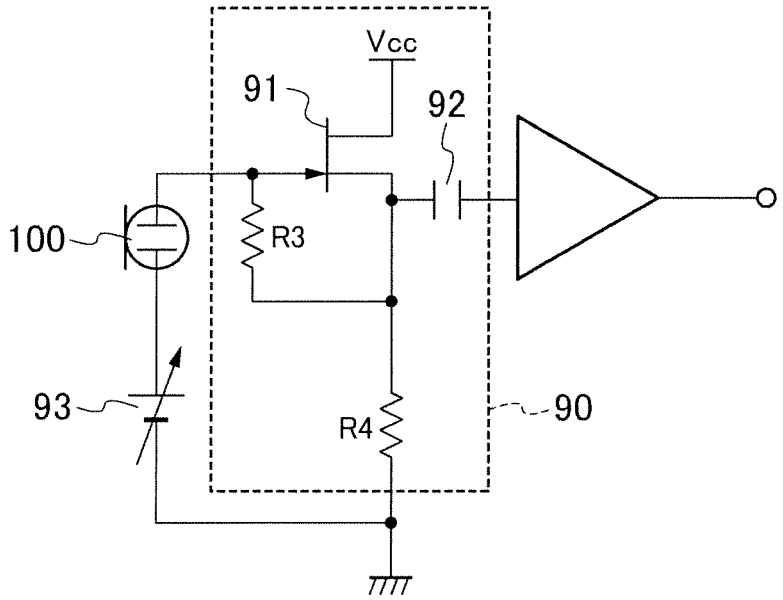
FIG. 18 is a circuit diagram illustrating still another example of an output level adjustment circuit of a microphone unit.

Further, to continuously change the characteristics of the directivities of the signals output from the output terminals A, B, and C, a sensitivity adjustment unit of the microphone unit can be provided between the microphone unit (10 to 30) and the signal amplification unit (40 to 55). FIG. 18 illustrates an example of a circuit configuration of a sensitivity adjustment unit using a condenser microphone as a microphone unit 100 (microphone unit being representative of any or all of microphone unites 10 to 30 discussed above).

The sensitivity adjustment unit illustrated in FIG. 18 includes an impedance converter 90 using an FET 91, resistances R3 and R4, and a condenser 92, and has a configuration to make an output voltage of a phantom power supply 93 variable, the phantom power supply 93 supplying a polarization voltage to the condenser microphone.

The phantom power supply 93 is supplied from a mixer. However, in FIG. 18, the phantom power supply 93 is illustrated in a simplified manner as if it exists near the microphone unit 100. Voltage adjustment of the phantom power supply 93 can be performed at the mixer.

Figure 19:
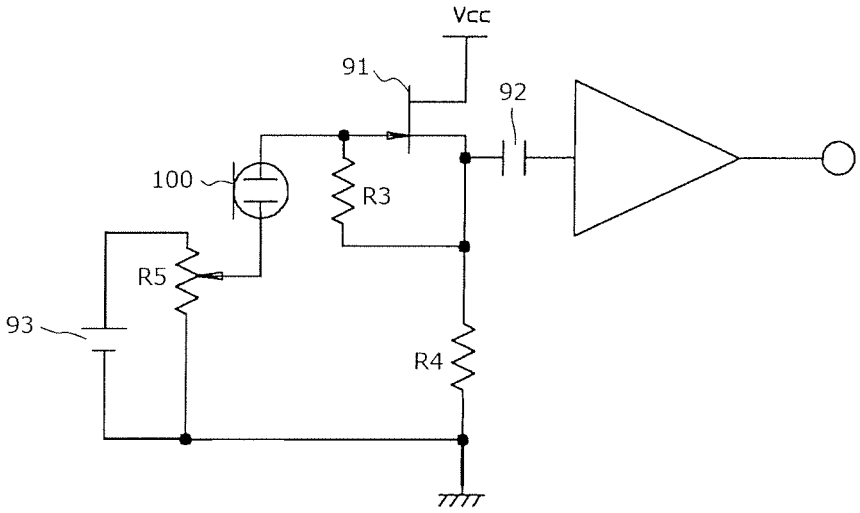
FIG. 19 is a circuit diagram illustrating a circuit configuration of FIG. 18 in more detail.

Further, in FIG. 18, the phantom power supply itself is illustrated like a variable voltage power supply. However, in reality, the voltage of the phantom power supply is converted through a DC-DC converter or a regulator. A specific circuit configuration to make the voltage of the phantom power supply variable is illustrated in FIG. 19. In the circuit illustrated in FIG. 19, the phantom power supply 93 and a variable resistance R5 are connected in parallel, and one of terminals of the microphone unit 100 is connected to a variable terminal of the variable resistance R5, so that a voltage value applied to the microphone unit 100 is adjusted. By adjusting the output voltage value of the phantom power supply 93 as described above, sensitivity of the microphone unit is adjusted, and the signal level output from the microphone unit to the signal amplification unit is adjusted.

By providing the sensitivity adjustment units illustrated in FIGS. 18 and 19 to the microphone units 10, 20, 25, and 30 illustrated in FIGS. 1 and 15, influence of the microphone units 10, 20, 25, and 30 is changed in the signal synthesized in the synthesis circuit 70. As a result, the directions of the unidirectional directional axes output from the terminals A, B, and C are continuously changed, and the patterns of the directivities are also changed at the same time.

For example, in the omnidirectional microphone unit 10, by setting the output voltage value of the phantom power supply 93 to be large, the pattern characteristics of the signals output from the output terminals A to C become more omnidirectional. On the other hand, by setting the output voltage value of the phantom power supply 93 to be small, the degree of reflection of the omnidirectional pattern characteristics in the signals output from the output terminals A to C becomes small.

By arbitrarily adding the sensitivity adjustment units and the level adjustment units as described above, the directional characteristics of the output signals supplied to an external apparatus can be individually and continuously adjusted.

To be specific, by adjusting a synthesis ratio of the outputs of the bi-directional microphone units 20 to 25, the directional axis can be continuously changed in an arbitrary direction on the XY plane. For example, when the synthesis ratio of the bi-directional microphone unit 25 to the bi-directional microphone unit 20 is continuously made large, the direction of the directional axis of the signal to be synthesized can be continuously tilted toward the directional axis of the bi-directional microphone unit 25.

Further, by adjusting the synthesis ratio of the output of the bi-directional microphone unit 20, 25, or 30 to the omnidirectional microphone unit 10, the pattern shape of the directional characteristics can be freely changed from a cardioid shape into a hyper cardioid shape or the like.

Further, by adjusting the synthesis ratio of the output of the bi-directional microphone unit 20 or 25 to the bi-directional microphone unit 30, an inclination of the directional axis in the Z axis direction can be continuously changed. For example, when the synthesis ratio of the bi-directional microphone unit 30 to the bi-directional microphone unit 20 is continuously made large, the direction of the directional axis of the signal to be synthesized is continuously tilted toward the directional axis (Z axis) of the bi-directional microphone unit 30.

The microphone and the microphone apparatus according to the present invention are expected to be used for various intended purposes such as a microphone installed in a concert hall or an open-air stage, for sound collection of music performance, and a table-installation microphone suitable for sound collection of conferences.

The connection forms in the synthesis circuit 70, that is, the synthesis forms of the signals illustrated and described in FIGS. 1 and 15 are examples. The synthesis circuit 70 may just synthesize at least one of the non-inverted signals and the inverted signals output from the bi-directional microphone units 20 and 25, and the output signals of the omnidirectional microphone unit 10 and the bi-directional microphone unit 30. With such a configuration, two or more output signals having directional axes in mutually different directions can be generated.

The number of the output terminals of the synthesis circuit 70 may just be a plural number, and a combination of the signals to be synthesized is arbitrary. In the synthesis circuit 70, a terminal that outputs the output signal of the microphone unit 10, 20, 25, or 30 as it is without synthesizing the output signal, a terminal that continuously changes and outputs the direction of the directional axis or the pattern shape of the directional characteristic may be additionally provided. By increasing the number of the signals output from the synthesis circuit 70 as described above, sound collection with multiple channels can be performed.

The switching of the direction of the directional axis and the adjustment of the microphone sensitivity by the output characteristics in the output signal processing unit, that is, the synthesis forms of the input signals may be performed by a configuration of a manual switching operation or a manual adjustment operation, or another configuration. For example, the direction of the sound source is detected for sound field collection, and the switching and the adjustment may be automatically performed such that the direction of the directional axis corresponds to the detected sound source direction. In this case, output wires of the microphone units 10, 20, 25, and 30 are branched and connected to a control apparatus such as a personal computer, and control based on outputs of the microphone units 10, 20, 25, and 30, which have been detected by the control apparatus, may just be performed. This control includes the switching of the switch of the synthesis circuit 70, the synthesis forms of the signals in the synthesis circuit 70, and the adjustment of the resistance value of the various types of variable resistors.

In the present embodiment, an example in which the microphone units 10, 20, 25, and 30 are condenser microphone units has been described. However, the microphone units are not limited to the example. For example, any one or more of the three bi-directional microphone units 20, 25, and 30 can be ribbon microphone units.

In the present embodiment, the microphone units 10, 20, and 25 are respectively positioned on the three straight lines passing through the one point (the center point of the substrate 21) and radially extending at intervals of 120 degrees in the circumferential direction. However, the position of the omnidirectional microphone unit 10 is not limited thereto. The position of the omnidirectional microphone unit 10 may just be arranged in the sound collection regions of the other microphone units 20, 25, and 30. Therefore, the omnidirectional microphone unit 10 can be arranged in an arbitrary position such as the center of the substrate 21, a position near the center, a vicinity of any of the bi-directional microphone units 20, 25, and 30. The direction of the omnidirectional microphone unit 10 is arbitrary.

In the present embodiment, the bi-directional microphone unit 30 is positioned on the center point of the substrate 21. However, the position of the bi-directional microphone unit 30 is not limited thereto. The position of the bi-directional microphone unit 30 may just be arranged in the sound collection regions of the other microphone units 10, 20, and 25, and can be arranged in an arbitrary position, similarly to the omnidirectional microphone unit 10.

Meanwhile, from the perspective of aligning the phases of the output signals among the microphone units 10, 20, 25, and 30 as much as possible, at least diaphragms of the bi-directional microphone units 20 and 25 are favorably arranged on the same plane.

In the present embodiment, an example of hanging and installing the microphone 1 from a ceiling of a concert hall or the like such that the directional axis of the bi-directional microphone unit 30 faces downward has been described. However, an embodiment is not limited to the example. The microphone 1 may be arranged such that the directional axis of the bi-directional microphone unit 30 faces upward by being embedded in a floor, a desktop, or the like, according to an intended purpose of the sound collection. As another example, the microphone 1 can be installed at various arbitrary angles such that the directional axis of the bi-directional microphone unit 30 is set in a diagonal direction or a cross direction.

Design change of the microphone and the microphone apparatus according to the present invention can be made without departing from the technical ideas described in claims.

What is claimed is:

1. A microphone comprising:

first and second bi-directional microphone units having respective directional axes arranged on two straight lines passing through one point and radially extending with an interval of 120 degrees;

a third bi-directional microphone unit having a directional axis arranged on a straight line perpendicular to a plane formed by the two straight lines; and an omnidirectional microphone unit arranged in sound collection regions of the first, second, and third bi-directional microphone units.

2. The microphone according to claim 1, wherein the first and second bi-directional microphone units are arranged on a circumference having the one point as a center point.

3. The microphone according to claim 2, wherein each of the first bi-directional microphone unit, the second bi-directional microphone unit, and the omnidirectional microphone unit have central portions, and wherein the central portion of the first bi-directional microphone unit, the central portion of the second bi-directional unit, and the central portion of the omnidirectional microphone unit are positioned on a circumference, and the one point is a center point of the circumference.

4. The microphone according to claim 1, wherein the omnidirectional microphone unit and the first and second bi-directional microphone unit are arranged on a circumference having the one point as a center point with intervals of 120 degrees respectively.

5. A microphone apparatus comprising:

first and second bi-directional microphone units having respective directional axes arranged on two straight lines passing through one point and radially extending with an interval of 120 degrees;

a third bi-directional microphone unit having a directional axis arranged on a straight line perpendicular to a plane formed by the two straight lines; and an omnidirectional microphone unit arranged in sound collection regions of the first, second, and third bi-directional microphone units; and a signal synthesis unit configured to synthesize at least one of respective non-inverted signals and inverted signals of the first and second bi-directional microphone units, an output signal of the third bi-directional microphone unit, and an output signal of the omnidirectional microphone unit to generate a plurality of output signals having directional axes in mutually different directions.

6. The microphone apparatus according to claim 5, further comprising:

a first signal processing unit configured to invert a phase of a positive-phase output signal from the first bi-directional microphone unit to generate the inverted signal, and output the positive-phase output signal and the inverted signal to the signal synthesis unit; and a second signal processing unit configured to invert a phase of a positive-phase output signal from the second bi-directional microphone unit to generate the inverted signal, and output the positive-phase output signal and the inverted signal to the signal synthesis unit.

7. The microphone apparatus according to claim 6, further comprising:

a third signal processing unit configured to amplify the output signal of the omnidirectional microphone unit and supply an amplified output signal to the signal synthesis unit; and a fourth signal processing unit configured to amplify the output signal of the third bi-directional microphone unit and supply an amplified output signal to the signal synthesis unit, wherein the first and second signal processing units perform non-inverting amplification or inverting amplification for the output signals of the corresponding bi-directional microphone units and supply signals subjected to the non-inverting amplification or inverting amplification to the signal synthesis unit.

8. The microphone apparatus according to claim 6, wherein a level adjustment unit that adjusts a level of the output signal of the corresponding microphone unit is included in at least one of the signal processing units.

9. The microphone apparatus according to claim 6, wherein the first and second signal processing units are the non-inverting/inverting amplification circuits, each of the non-inverting/inverting amplification circuits is a balance output circuit, the balance output circuit comprises a transistor, an emitter resistance and a collector resistance connected to the transistor, wherein the non-inverting amplification and the inverting amplification for the output signals are derived from the emitter resistance and the collector resistance.

10. The microphone apparatus according to claim 5, wherein the signal synthesis unit includes first to third three output terminals for outputting the generated output signals, and outputs the plurality of generated output signals from the mutually different output terminals.

11. The microphone apparatus according to claim 10, wherein the signal synthesis unit outputs output signals having three unidirectivities with directional axes in mutually different directions from the mutually different output terminals.

12. The microphone apparatus according to claim 11, wherein a unidirectional output by a cardioid shape characteristic with a directional axis rotated downward by 45 degrees and leftward by 120 degrees is obtained from the first output terminal, a unidirectional output by a cardioid shape characteristic with a directional axis rotated downward by 45 degrees and rightward by 120 degrees is obtained from the second output terminal, and a unidirectional output by a cardioid shape characteristic with a directional axis facing a front direction and downward by 45 degrees is output from the third output terminal.

13. The microphone apparatus according to claim 11, wherein the signal synthesis unit adds the output signal from the omnidirectional microphone unit and the output signal from the third bi-directional microphone unit to a positive-phase output signal from the first bi-directional microphone unit and outputs an added output signal from one output terminal, adds the output signal of the omnidirectional microphone unit and the output signal from the third bi-directional microphone unit to a positive-phase output signal from the second bi-directional microphone unit and outputs an added output signal from another output terminal, and adds a negative-phase inverted signal from the first bi-directional microphone unit, the output signal from the omnidirectional microphone unit, and the output signal from the third bi-directional microphone unit to a negative-phase inverted signal from the second bi-directional microphone unit and output an added output signal from still another output terminal.

14. The microphone apparatus according to claim 13, wherein the signal synthesis unit outputs output signals having three unidirectivities in which directions of directional axes are mutually shifted by 120 degrees on a plane formed by the two straight lines, and inclinations of the directional axes with respect to the plane are equal to one another, from the mutually different output terminals.

15. The microphone apparatus according to claim 11, wherein the signal synthesis unit adds the output signal from the omnidirectional microphone unit, a negative-phase inverted signal from the second bi-directional microphone unit, and the output signal from the third bi-directional microphone unit to a positive-phase output signal from the first bi-directional microphone unit and outputs an added output signal from one output terminal, adds the output signal from the omnidirectional microphone unit, the negative-phase inverted signal from the first bi-directional microphone unit, and the output signal from the third bi-directional microphone unit to a positive-phase output signal from the second bi-directional microphone unit and output an added output signal from another output terminal, and adds the negative-phase inverted signal from the first bi-directional microphone unit, the output signal from the omnidirectional microphone unit, and the output signal from the third bi-directional microphone unit to the negative-phase inverted signal from the second bi-directional microphone unit and outputs an added output signal from still another output terminal.

16. The microphone apparatus according to claim 15, wherein the signal synthesis unit outputs output signals having three unidirectivities in which directions of directional axes are mutually shifted by 90 degrees on a plane formed by the two straight lines, and inclinations of the directional axes with respect to the plane are equal to one another, from the mutually different output terminals.

17. The microphone apparatus according to claim 5, wherein a sensitivity adjustment unit that adjusts sensitivity of the microphone is included in at least one of the microphone units.

18. The microphone apparatus according to claim 17, wherein one or more of the microphone units are condenser microphones, the sensitivity adjustment unit comprises a voltage adjustment means which adjusts a voltage derived from a phantom power supply of at least one condenser microphone of the condenser microphones for supplying to bias resistances connected to the at least one condenser microphone.

* * * * *